US008263849B2

(12) United States Patent
Chamberlin et al.

(10) Patent No.: US 8,263,849 B2
(45) Date of Patent: Sep. 11, 2012

(54) FLASH MEMORY BASED STORED SAMPLE ELECTRONIC MUSIC SYNTHESIZER

(75) Inventors: Howard Chamberlin, Waltham, MA (US); Timothy Thompson, Marlborough, MA (US); Mark Miller, Marlborough, MA (US); Sivaraman Natarajan, Philadelphia, PA (US)

(73) Assignee: Young Chang Research and Development Institute, Waltham, MA (US)

( * ) Notice: Subject to any disclaimer, the term of this patent is extended or adjusted under 35 U.S.C. 154(b) by 0 days.

(21) Appl. No.: 12/636,275

(22) Filed: Dec. 11, 2009

(65) Prior Publication Data

US 2010/0147138 A1 Jun. 17, 2010

Related U.S. Application Data

(60) Provisional application No. 61/122,180, filed on Dec. 12, 2008.

(51) Int. Cl.
*G10H 7/00* (2006.01)

(52) U.S. Cl. ..... 84/603

(58) Field of Classification Search ..... 84/603
See application file for complete search history.

(56) References Cited

U.S. PATENT DOCUMENTS

| | | | | |
|---|---|---|---|---|
| 5,489,746 | A * | 2/1996 | Suzuki et al. | 84/602 |
| 5,811,706 | A * | 9/1998 | Van Buskirk et al. | 84/604 |
| 6,008,446 | A * | 12/1999 | Van Buskirk et al. | 84/603 |
| 7,723,601 | B2 * | 5/2010 | Kamath et al. | 84/604 |
| 2006/0136228 | A1 * | 6/2006 | Lin | 704/278 |
| 2006/0196345 | A1 * | 9/2006 | Arai | 84/604 |
| 2008/0078280 | A1 * | 4/2008 | Okazaki et al. | 84/604 |
| 2010/0236384 | A1 * | 9/2010 | Shirahama et al. | 84/605 |

* cited by examiner

*Primary Examiner* — Jeffrey Donels
(74) *Attorney, Agent, or Firm* — Cesari and McKenna, LLP

(57) ABSTRACT

A flash-memory based stored-sample electronic music synthesizer enables the electronic reproduction of a large number of independent voices while accommodating the exacting demands of voice continuity, minimal note-start latency, and voice synchronicity.

12 Claims, 6 Drawing Sheets

FLASH MEMORY BASED STORED SAMPLE ELECTRONIC MUSIC SYNTHESIZER

CROSS-REFERENCE TO RELATED APPLICATIONS

The present application claims the benefit of U.S. Provisional Patent Application Ser. No. 61/122,180, which was filed on Dec. 12, 2008, by Howard Chamberlin et al. for a FLASH MEMORY BASED STORED SAMPLE ELECTRONIC MUSIC SYNTHESIZER and is hereby incorporated by reference.

BACKGROUND OF THE INVENTION

1. Field of the Invention

The invention relates to electronic music synthesizers using stored samples of one or more instruments to play a desired composition. In particular, the invention comprises a flash-memory based stored-sample electronic music synthesizer.

2. Background Information

Since their commercial introduction in the 1950s, a variety of electronic music synthesizers have been developed and used. Early synthesizers were largely analog in nature, and provided tonal output by operating on basic waveforms such as sine waves, sawtooth waves, rectangular waves, and the like. With the advent of digital signal processing, music synthesizers increasingly turned to digital techniques to construct desired sound patterns. One common technique was additive synthesis, in which the basic Fourier constituents of a desired sound are assembled to create the sound. Another technique used stored samples of actual sounds, such as that of a violin, a piano, a horn, etc., and manipulated these samples, such as by changing their amplitude, frequency, phase, duration, etc., to provide an output.

Stored-sample synthesizers are capable of high quality reproduction of desired sounds but, to do so, typically require substantial quantities of fast memory to both store the large number of samples required for a quality instrument and to provide those samples at a sufficient rate for playback. One approach that has been proposed to address this problem is described in U.S. Pat. No. 6,008,446, issued Dec. 28, 1999 to Van Buskirk et al. and entitled "Synthesizer System Utilizing Mass Storage Devices For Real Time, Low Latency Access of Musical Instrument Digital Samples". This system proposes to store the sample data on a mass storage device such as a hard disk and to play the samples back using the fast but expensive random access memory (RAM) of a host computer. Substantial amounts of RAM are required in such a system, and the cost of the system is thereby significantly increased. Thus, the proposed system does not satisfactorily address the problem.

SUMMARY OF THE INVENTION

In accordance with the present invention, all samples which the instrument is capable of playing are stored in a flash memory, specifically, NAND flash memory. NAND flash memory is a very low cost but relatively slow (e.g., 25 μs retrieval time) form of auxiliary memory, and retrieval of data from the memory can take place only a page at a time, a page usually containing 2K (2048) bytes of 16-bit samples. Further, flash memory does not provide random access to the stored data. The retrieval accordingly must take place on page boundaries, which typically will not align with the start and end of the sample set of a sound to be played.

In accordance with a preferred embodiment of the present invention, on activation of a key indicating a sound to be played, a sample playback engine determines the page or pages in which the desired samples are located (e.g., by means of a lookup table), retrieves the indicated samples from flash memory, and stores them in buffer memory. The buffer memory is preferably a fast double data rate synchronous dynamic random access memory (DDR2 SDRAM). In the preferred embodiment, the buffer memory is divided into groups of buffers, one group for each "voice' that can be played on the instrument. Since the set of samples for a particular sound may span more than one page, retrieval of the first page of a sample set is usually followed by retrieval of subsequent pages associated with the sample set. Further, in the preferred embodiment, the buffer group for each voice comprises a pair of primary buffers for holding non-repeating portions of a voice sample, e.g., the "attack' portion of a sound, as well as a pair of loop buffers for holding portions of a sound which may be repeated by looping on itself. During the playing of a voice, the primary buffers are loaded in alternating fashion, i.e., A-B-A-B-A. etc. Playback of a voice does not begin until at least both primary buffers of each of the voices to be started have been loaded into buffer memory. This ensures voice continuity. In contrast, the loop buffers need to be loaded once only during the playing of a voice, and do not change during play of the voice.

To initiate a voice (i.e., to start the playing of a sound such as a musical note), a sample playback engine sends a request to a NAND flash interface to fetch a page of memory from the flash memory. This request identifies the voice number and the starting address of the sample set which is to be retrieved. On retrieving the requested data, the interface passes it on to a buffer memory controller for storage in the appropriate buffer memory and subsequent playback.

Since sound samples are retrieved from memory sequentially but may be played in parallel, efficient synchronization of sound playback is essential. In the preferred embodiment of the present invention, for example, under certain circumstances, up to 128 channels or voices could possibly be played simultaneously. Some of these voices may need to start simultaneously, or otherwise be synchronized with each other. Further, requests for new voices to start should be serviced with minimum latency, while not interfering with the continuance of a presently-playing voice.

These conflicting requirements (continuity of a presently-playing voice and minimum latency in starting a new voice) are accommodated in the preferred embodiment of the present invention by a unique time-slot allocation scheme. In particular, the basic cycle time of the synthesizer is determined by the time required to play the contents of a sample buffer. For a sample buffer of 1 K (1024 bytes) in size and for high-quality sound reproduction (95,970 samples/second), a cycle time T of 10.67 ms (milliseconds) is indicated. Within this time, all the actions required to start, continue, and stop all the voices to be played during that cycle must be accomplished.

To enable this to be done, we divide the basic cycle time T into a number of time slots of smaller size, at least one slot for each of the voices that may be played on the synthesizer ("normal slot times"), plus a number of additional slots dedicated to starting new voices with minimal latency while allowing continuity of presently-playing voices ("extra slot times"). During "normal" slot-times, the requirements of presently-playing voices are serviced; if no presently-playing voice requires servicing in the time slot assigned to it, it may be used to service a request for a new voice start. During "extra" slot times, new voices may be started.

The performance of flash memory in the synthesizer is further enhanced by embedding error correction code in the sample data as described more fully hereafter.

The present invention provides a synthesizer whose sound samples can readily be changed merely by changing the flash memory. Thus, the memory may contain a large number or a small number of samples, may contain sounds specific to one culture or another, or may be differentiated in numerous other ways. It imparts a unique personality to the instrument and its low manufacturing cost and easy programmability enables the possibility of widespread distribution in the market.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
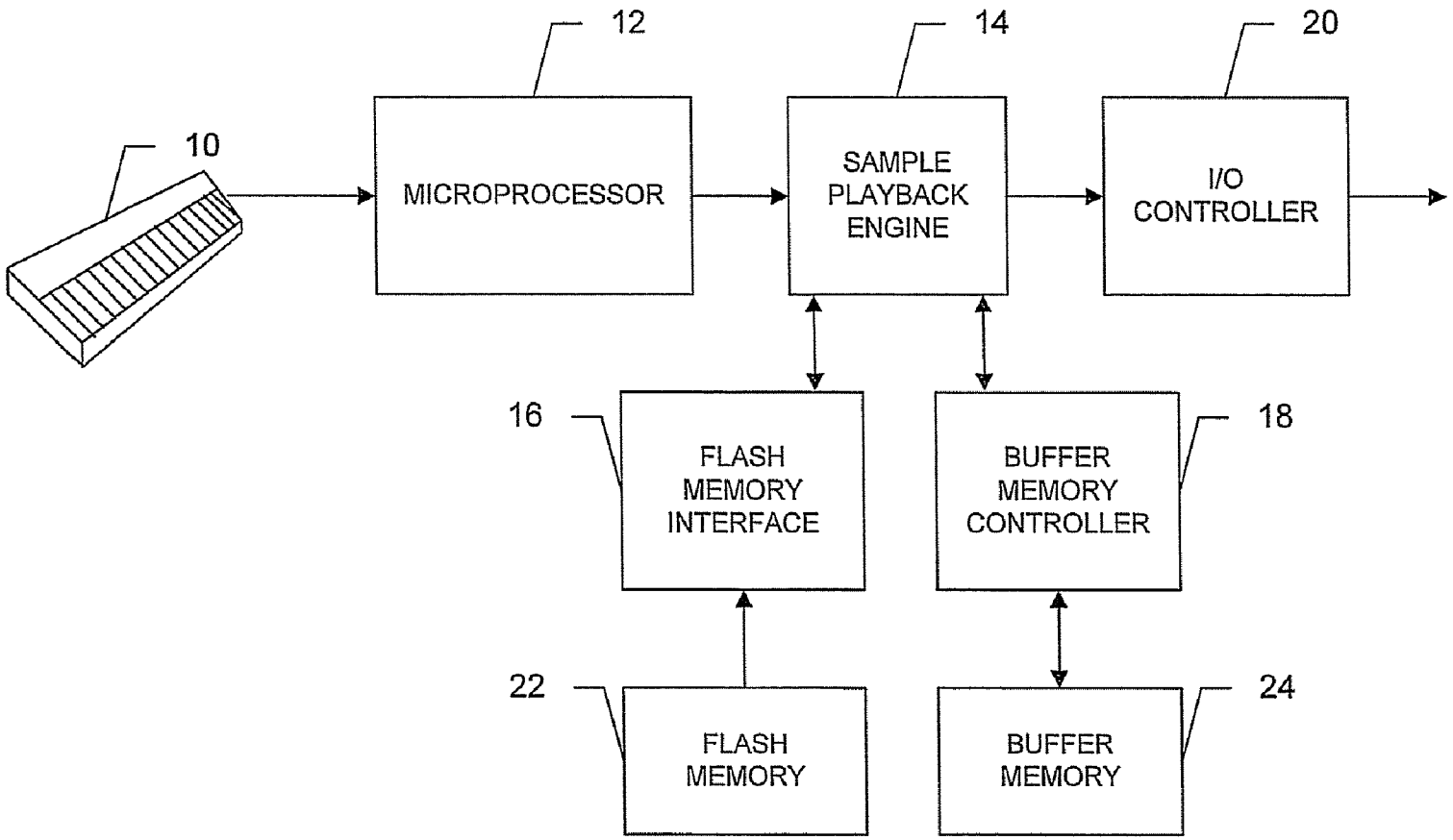
FIG. 1 is a block diagram of a flash memory based electronic music synthesizer in accordance with one embodiment of the present invention.

In FIG. 1, an input device 10 such as a piano keyboard provides control inputs through a microprocessor 12 to a sample playback engine 14 for controlling the playback of sounds such as musical notes and the like. The control inputs specify, for example, a particular note to be played, its intensity, its duration, and possibly other characteristics. The microprocessor sets up various registers in the sample playback engine for retrieving and playing sound samples in accordance with these inputs. The microprocessor has limited memory capability, and does not itself store or process the sound samples. Sample playback engines are well known in music synthesis and accordingly only those functions unique to the present invention will be described in detail.

The playback engine operates on stored sample data supplied to it to provide the desired output. To this end, the playback engine 14 is connected to a flash memory interface 16 and to a buffer memory controller 18. Flash memory interface 16 retrieves data from flash memory 22 on request from the sample playback engine. The retrieved data is returned via interface 16 to buffer memory controller 18 and thence is stored in a buffer memory 24. The output of the playback engine is applied through an I/O Controller 20 to one or more output devices (not shown) such as a sound system, recording devices, etc.

Flash memory 22 is preferably a NAND memory. Such a device offers high memory capacity (e.g., gigabytes or more) in a small volume at a dramatically low price in comparison with other forms of memory. It is quickly loadable with data, and does not require special masks or processing. Thus, it provides an excellent media for storing the large quantities of sample data required for high-quality sampled-sound synthesis. On the other hand, it is relatively slow (on the order of 25 μs retrieval time) and page-oriented, and thus not adequate by itself to provide data samples on a consistent schedule for real-time sound reproduction. Buffer memory 24, in conjunction with the procedures defined by the present invention for establishing a continuous, rapid flow of sample data, fills this void and enables use of NAND flash memory to provide a fully-voiced instrument capable of responsive high-quality real time performance.

Figure 2:
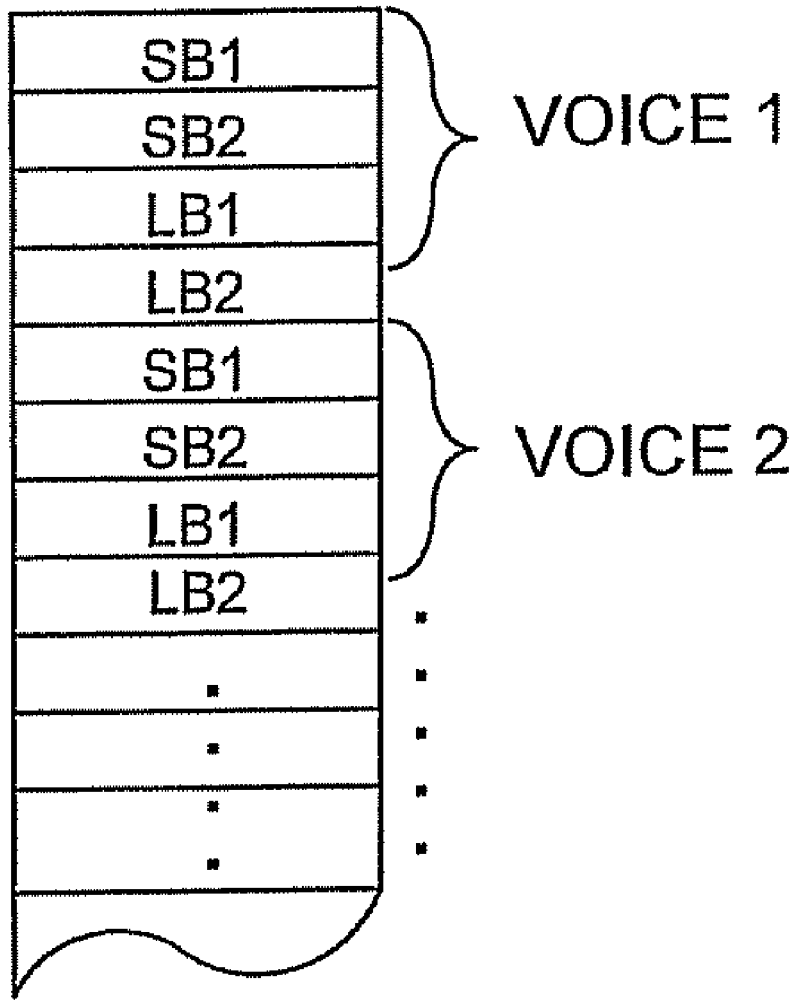
FIG. 2 is a diagram of the buffer memory of FIG. 1.

In particular, buffer memory 24 comprises a relatively fast RAM memory, preferably DDR2 SDRAM, for holding the retrieved samples prior to their output. FIG. 2 shows the preferred layout of this memory as implemented in the preferred embodiment of the invention. As shown in that Figure, each voice to be played on the synthesizer is allocated a group of four buffers, each capable of holding 1 kilobyte of 16-bit words. Two of the buffers for each voice, labeled SB1 ("sample buffer one") and SB2, receive non-looped samples for a voice to be played; the other two, labeled LB1 ("loop buffer one") and LB2, receive samples associated with the loop point of the voice, to the extent that there is one.

When a voice is initiated (e.g., by pressing a key on the keyboard 10), the playback engine 14 sends to the flash memory interface 16 a fetch command indicating the voice number and the starting address for of the set of samples to be played. Samples are read a page at a time. A sample set for a particular voice and note may span a number of pages or may be confined to a single page. When multiple pages are to be fetched, the first page is retrieved from flash memory, returned to the interface 16, passed to the buffer memory controller 18, and thence stored in buffer memory 24. The first half-page or sector (1 KiB) of the sample set is stored in buffer memory SB1; the next half page or sector is stored in buffer memory SB2. Samples are retrieved from flash memory and loaded into the sample buffer memory at the rate of approximately one 1 K (1024) samples every 10.67 milliseconds for every voice being played, so that samples are available for playback at a rate of approximately 96,000 samples/second.

The sample playback engine is informed of the loading of the sample buffer memories SB1 and SB2, and no playback is started by the engine until both of these memories are loaded. Once both are loaded, playback can begin. During playback, sample sectors are repeatedly fetched from flash memory as needed and supplied to the buffer memories. In the case of non-looped samples, the buffers SB1 and SB2 are filled in alternating fashion, i.e., as the contents of a buffer, e.g., SB1 or SB2 is used, it is replenished by a new sample set while its companion buffer is being read out. Thus, the order of loading is SB1-SB2-SB1-SB2-etc. In the case of looped samples, in contrast, the loop memory buffers LB1 and LB2 are loaded once only during playback of the non-looped buffers; their contents thereafter remain unchanged for the duration of playback of the particular voice.

In some instances, the voice to be played will be of sufficiently short duration as not to require all four buffers. For example, if the sample set for a selected voice resides in a single half-page (one sector) in flash memory, the sample playback engine and the flash memory controller will cause the retrieved data to be stored in LB1, and this buffer will be used for the entire playback. And whenever there is a loop point in the sample set, the sample playback engine and the flash memory controller will cause the sector containing the loop point to be stored in LB1; the sector following the loop point will then be stored in LB2.

The order in which the sample buffers are played back depends on the length of the sample set of the voice being played. For a small sample set of not more than two sectors, the sample set is stored in (and thus played back from) buffer LB1 (single sector) or LB1 and LB2 (double sector) only, whether or not the sample set contains a loop point. For a sample set containing three or more sectors, the sample sets are stored in (and thus played back from) LB1, LB2, and one or more of SB1 and SB2, with the latter alternating as necessary to complete sample set.

The timing of the data flow within the system is an important constraint on the operation of the synthesizer. Voice output can take place simultaneously, while access to sample memory is sequential. Thus, a basic data cycle must be established that accommodates the maximum demand for data. A first major constraint is that no active voice (i.e., a voice currently playing a note) should run out of data during play (the requirement of "voice continuity"). Since the buffer for a given voice can emptied at a rate of approximately 96,000 samples/second (i.e., 10.67 ms for a 1 K buffer) for high quality sound, each set of voice buffers must be filled every basic voice service cycle time T of 10.67 milliseconds.

For a 128-voice synthesizer, in which all voices could in theory be playing simultaneously, each buffer is allowed up to 10.67/128=83.4 microseconds for filling, assuming that all voices are playing at a given time and that all load the same amount of data. This sets an upper limit on the allowed time for filling sample buffers. In practice, we have found that a voice can be serviced, i.e., its buffers filled and the voice prepared to play, in a much shorter time, specifically, approximately 58 microseconds. This enables other activities to be performed during the basic cycle time.

In particular, we divide the voice servicing cycle time T into 184 time slots of approximately 58 μs each. 128 of these slots (referred to herein as "normal" time slots) are available for servicing continued note play, as well as to start new voices if not needed for continuing note play; the remainder (referred to herein as "extra" time slots) are available for servicing new voice starts. By judiciously interspersing the sequence of servicing the various requests involved in playing the voices, we can not only ensure that no active voice runs out of data (voice continuity) but can also satisfy a second important constraint, namely, that requests for new voice starts are promptly serviced ("minimal latency").

Figure 3:
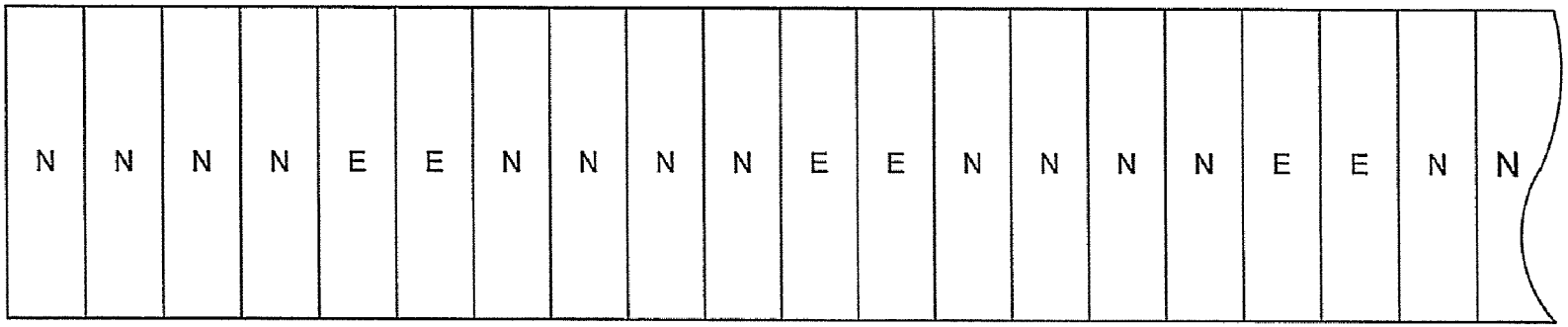
FIG. 3 is a diagram of a time sequence for servicing requests in accordance with a preferred embodiment of the invention.

FIG. 3 of the drawings shows an arrangement of normal and extra time slots that we have found to work particularly well. In FIG. 3, the basic cycle time of 10.67 ms is divided into 184 time slots of approximately 58 μs each. Two types of slots are shown: "normal" (N) and "extra" (E). The cycle time T is divided into repeating sequences of four normal slots (N) followed by two extra slots (E). Normal time slots are used for servicing requests for data for active voices; additionally, they are used to service requests for new voice starts when not needed for servicing requests for data for active (continuing) voices. Extra time slots are used to service requests for new voice starts. The use of these time slots is shown in more detail FIGS. 4A and 4B.

Figure 4A:
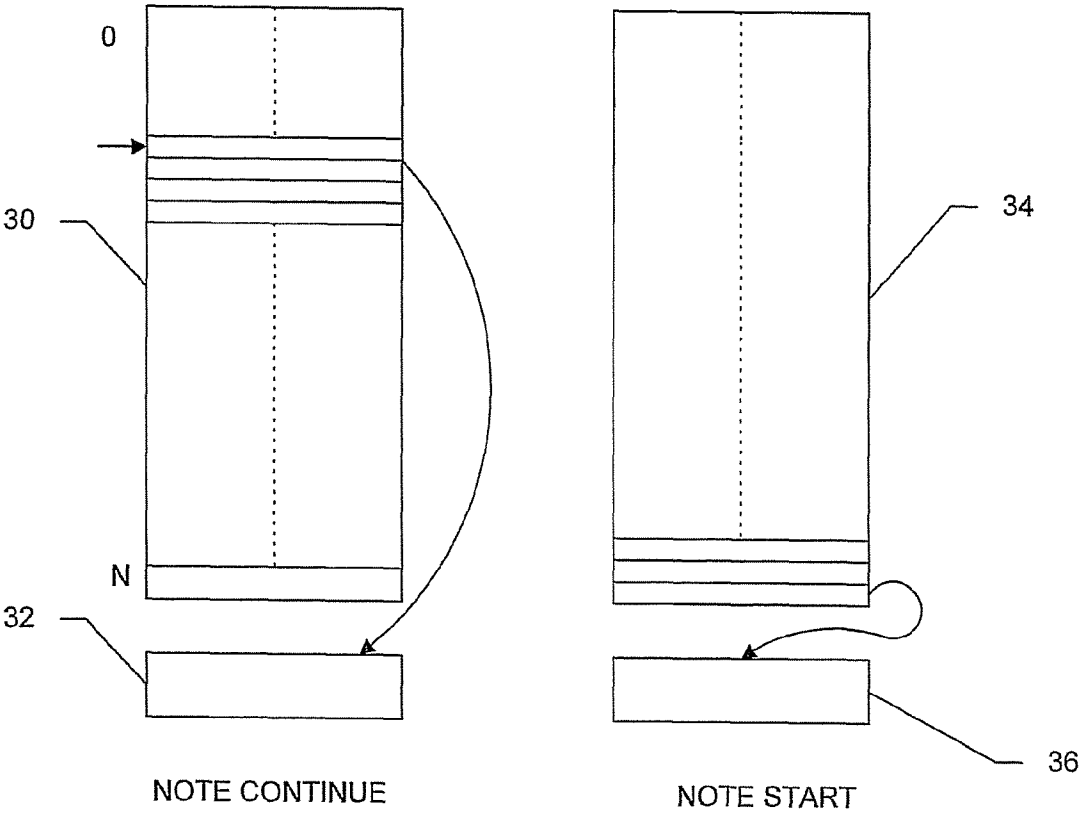
FIG. 4 is a flow diagram of the manner of servicing the requests.

In FIG. 4A, a memory segment 30 receives and stores information about the voices to be played, including the sector and page address, among other information. Segment 30 is preferably implemented as linearly addressable RAM (random access memory), with memory locations 0 through N−1, corresponding to N voices. During a basic time cycle T, the system cycles through each of the storage locations in sequence in synchrony with each time slot. If, during a given time slot, a voice is currently playing and further data is needed for it, the identifying information associated with that voice is read from the memory segment 30 into a buffer 32 to enable retrieval of that data. In addition, a FIFO (first in, first out) memory 34 receives and stores the same type of information for new voices which are to be started. A buffer 36 holds the latest such request; earlier unserviced requests are stored in memory 34.

Figure 4B:
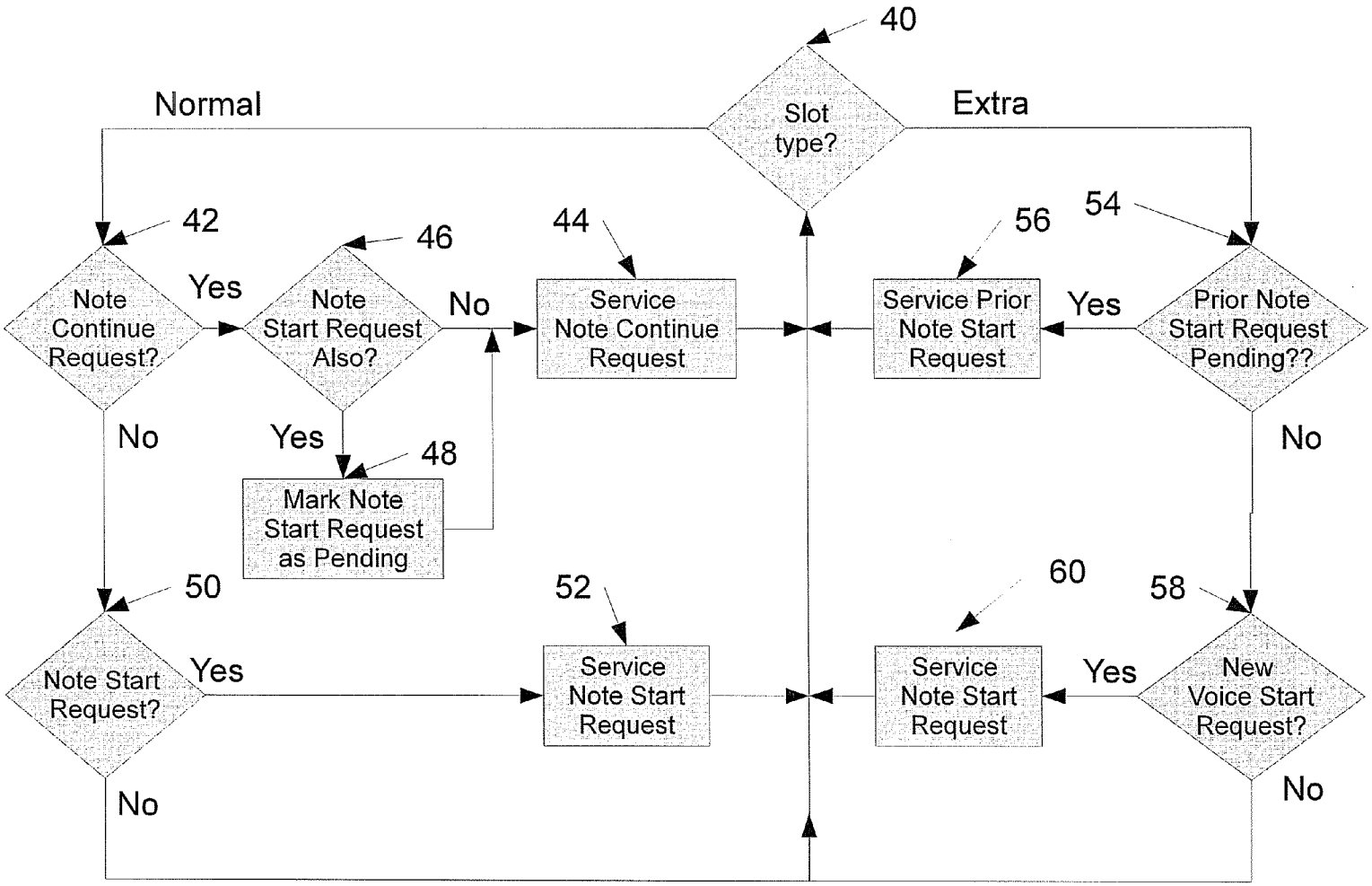

Turning now to FIG. 4B, there is shown a flow diagram of a timing program for servicing requests for sample data from the NAND flash memory. As the system steps through each time slot in sequence, the slot type corresponding to a given time slot is determined (step 40). If it is a normal time slot, it is next determined (step 42) whether additional sample data for a currently-active voice is being requested in that time slot. If it is, the request is serviced (step 44) by retrieving the requested data for that voice, using the address information stored in buffer 32 (FIG. 4A) at this time. Since it is possible that a new voice can be started in a normal time slot, it is further determined (step 46) whether a new voice start is also being requested in the current time slot. If it is, the new voice request is marked "pending" (step 48) but is not serviced at this time, since priority is given to servicing the currently-active voice (step 44). If, in contrast, no data for a currently active voice is being requested, it is next determined (step 50) whether there is a request for a news voice start in the current time slot. If there is, the request is serviced (step 52) using the address and other information in buffer 36 (FIG. 4A). If not, examination of the current time slot is complete and the system waits for the next time slot to occur.

If, in contrast, the current time slot is an extra slot, it is first determined (step 54) whether there is an unserviced request for a new voice start. If there is, the request is serviced (step 56) using the address and other information in buffer 36 (FIG. 4A). If not, it is next determined whether there is a request for starting a new voice (step 58). If there is, the request is serviced (step 60) using the information in buffer 36.

As discussed above, it is essential that once a voice is started, it not run out of data samples during its play. To ensure that this is the case in even the most demanding circumstances, e.g., when all normal time-slots are occupied by continuing voice play, each request for a new voice start is actually implemented as two requests that are stored in the FIFO memory 34. Each request, when serviced, will load a segment of sample into the sample buffer for that voice. Thus, regardless of when in the basic cycle time a new voice is to be started, the new voice will be started with minimal latency.

In this manner, a servicing priority is created, with currently playing voices receiving highest servicing priority, and requests for new voice starts thereafter being serviced in the order received. Thus, with proper interspersal of normal and extra voice slots as described above, voice continuity of presently playing voices can be preserved, while the latency of new voice starts can be minimized.

In order to further enhance the quality of the playback, synchronization of playback of voices started simultaneously by the user (e.g., by striking several keys on an input keyboard simultaneously) is achieved by providing in the sample playback engine a voice synchronization buffer containing one or more bits for each voice to be started simultaneously. As the data from each voice is retrieved from NAND flash memory and stored in the sample playback buffers, the corresponding bit or bits in the synchronization buffer for each voice is set. The status of the buffer is monitored. When the bits for each voice to be started are found to be set, playback of the designated voices commences.

As earlier discussed, NAND flash memory is inherently slow as compared to most other memory types. Additionally, it is strongly susceptible to data corruption due to bit faults in the manufacturing process, as well as arising from repeated use. To address this issue, provisions are made to add error correction data to each page of data stored in the flash memory in a section separate from the data of that page. As the pages are read, the ECC code is separately read and corrections are made as necessary. This increases the read time of the data in the memory.

Figure 5:
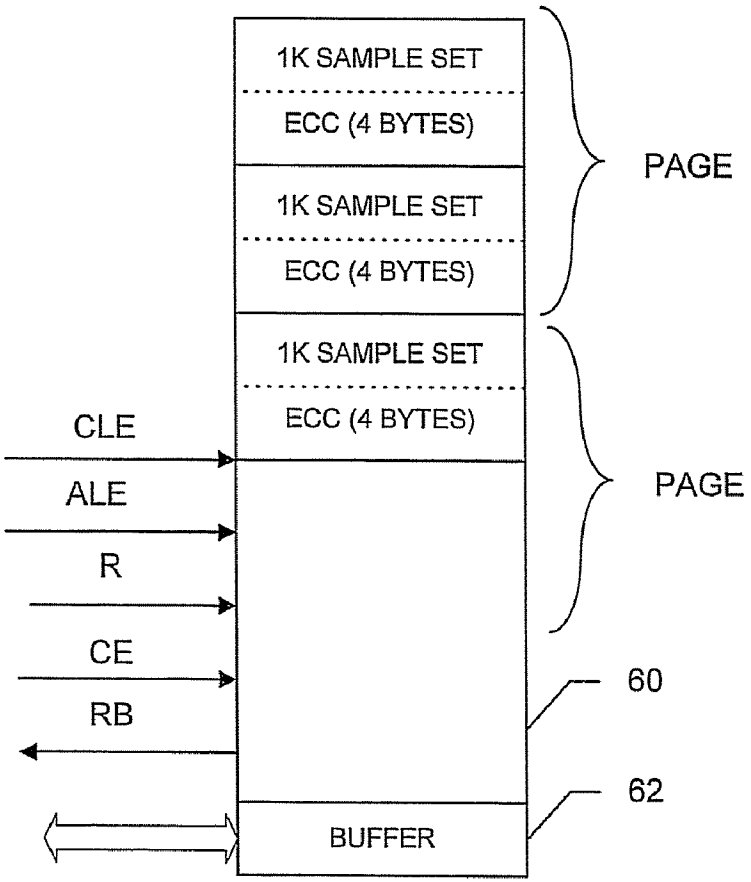
FIG. 5 illustrates the manner in which data and error correction code are stored in flash memory to enhance its the performance.

We have determined that we can meaningfully decrease the read time of NAND flash memory by changing the manner in which the ECC code is stored in the flash memory. FIG. 5 shows the manner in which we store sample data and error correction code in a flash memory 60. The memory typically has a number of lines for transferring data and commands, e.g., CLE (command latch enable), ALE (address latch enable), R (read), W (write), CE (chip enable), and RB (ready busy), as well as a buffer 62 for holding data being read. Rather than storing the error correction code after each page as is conventional, for each page of flash memory we store the sound sample data in one kilobyte segments, followed by 4 bytes of error correction code for that segment. As each page is read, it is transferred into buffer 62, from which the particular segment being requested is extracted, together with its associated error correction code. Thus, a single read is required to obtain the desired data and its associated error correction code, as opposed to two separate reads. This saves over 100 nanoseconds on each read, and further enables accommodation of otherwise slow NAND memory to the demanding data bandwidth requirements of a sampled data synthesizer.

For purposes of illustration, the input device to the system has been shown as a keyboard. It will be understood that an unlimited variety of input devices may be used instead, as long as they can provide the necessary outputs to indicate the desired characteristics of a sound to be output by the system, e.g., note, duration, etc. For example, and without limitation, the input may comprise electronic signals that have previously been stored and that are now applied to the system to cause audible or other reproduction by the system. Further, it will be understood that the output of the system similarly may take a variety of forms, e.g., a loudspeaker or a recording medium, acoustic or electronic, among others. Additionally, it will be understood that the term "play" herein is not limited to acoustic output, but is used in the broad sense of providing selected data to an output device.

From the foregoing, it will be seen that we have provided a flash-memory based stored-sample electronic music synthesizer that enables the electronic reproduction of a large number of independent voices while accommodating the exacting demands of voice continuity, minimal note-start latency, and voice synchronicity. It will be understood that various changes may be made in the foregoing without departing from the spirit or scope of the invention, the scope of the invention being defined with particularity in the claims.

What is claimed is:

1. A stored sample music synthesizer, comprising an input source for selecting one or more voices to be played;

an output for receiving digital representations of the selected voices;

a flash memory for storing voice samples;

a buffer memory for receiving selected voice samples from said flash memory, said buffer memory comprising, for each voice, at least a first sample buffer memory for holding samples of the voice to be played and at least a first loop memory for holding samples containing a loop point of the voice; and a sample playback engine responsive to said input source for selecting voice samples from said flash memory and storing them into said buffer memory for transmission to said output.

2. A music synthesizer according to claim 1 in which said buffer memory contains, for each voice, at least first and second sample buffer memories, said memories being filled and emptied in alternate fashion during voice play as needed to provide output samples for the voice being played.

3. A music synthesizer according to claim 2 in which said buffer memory contains, for each voice, at least first and second loop memories, said memories being filled in sequential fashion during voice play as needed to provide output samples for the voice being played.

4. A music synthesizer according to claim 2 in which said first and second sample buffer memories for a voice to be played are filled from said flash storage before voice play begins.

5. A music synthesizer according to claim 3 in which said first and second sample buffer memories for a voice to be played are filled from said flash storage before voice play begins.

6. A music synthesizer according to claim 1 which includes a synchronization buffer containing at least one bit for each voice to be played simultaneously, the bits for a voice being set when the samples required for play of the voice is stored in buffer memory.

7. A music synthesizer according to claim 6 in which said synchronization buffer is used to start a group of voices simultaneously when the bits corresponding to each voice of the group are set.

8. A method of servicing requests for data in a music synthesizer, comprising establishing a basic cycle time for loading data into sample buffers for subsequent processing by the synthesizer;

allocating a first group of time-segments of said cycle time at least for continuing play of each of a plurality of voices to be played by the synthesizer;

allocating a second group of time-segments of said cycle time for starting new voices to be played by the synthesizer, said second group of segments being interspersed among said first group.

9. The method of claim 8 in which said second group of segments is interspersed among said first group at regular intervals.

10. The method of claim 8 in which said basic cycle time is divided into repetitions of four time-segments for continuing play of each of a plurality of voices to be played by the synthesizer, followed by one or more time-segments for starting new voices to be played by the synthesizer.

11. The method of claim 8 in which said basic cycle time is divided into repetitions of four time-segments for continuing play of each of a plurality of voices to be played by the synthesizer, followed by two time-segments for starting new voices to be played by the synthesizer.

12. The method of claim 7 in which a pair of new voice start requests are made for each new voice to be started.

* * * * *